US005877393A

United States Patent [19]

Webster

[11] Patent Number: 5,877,393

[45] Date of Patent: Mar. 2, 1999

[54] TREATMENT PROCESS FOR CONTAMINATED WASTE

[75] Inventor: William C. Webster, Auburn, Ala.

[73] Assignee: Solucorp Industries, Ltd., West Nyack, N.Y.

[21] Appl. No.: 892,465

[22] Filed: Jul. 14, 1997

Related U.S. Application Data

[63] Continuation of Ser. No. 705,794, Aug. 30, 1996, abandoned.

[51] Int. Cl.[6] ..... A62D 3/00

[52] U.S. Cl. ..... 588/236; 405/128; 405/263; 588/251; 588/256

[58] Field of Search ..... 405/128, 129, 405/263; 588/231, 236, 251, 252, 256, 257

[56] References Cited

U.S. PATENT DOCUMENTS

| | | | |
|---|---|---|---|
| 4,278,539 | 7/1981 | Santhanam et al. | 210/724 |
| 4,329,224 | 5/1982 | Kim | 210/709 |
| 4,354,942 | 10/1982 | Kaczur et al. | 588/256 |
| 4,534,942 | 8/1985 | Grasset et al. | 422/117 |
| 4,629,509 | 12/1986 | O'Hara et al. | 405/128 |
| 4,737,356 | 4/1988 | O'Hara et al. | 405/128 |
| 4,889,640 | 12/1989 | Stanforth | 210/751 |
| 4,943,377 | 7/1990 | Legare, III | 210/709 |
| 4,950,409 | 8/1990 | Stanforth | 210/751 |
| 5,037,479 | 8/1991 | Stanforth | 106/691 |
| 5,139,365 | 8/1992 | Chesner | 405/129 |
| 5,162,600 | 11/1992 | Cody et al. | 405/263 |
| 5,202,033 | 4/1993 | Stanforth et al. | 210/747 |
| 5,234,485 | 8/1993 | Bolsing | 405/263 |
| 5,397,478 | 3/1995 | Pal et al. | 588/256 |
| 5,512,702 | 4/1996 | Ryan et al. | 588/256 |
| 5,536,899 | 7/1996 | Forrester | 588/260 |
| 5,569,155 | 10/1996 | Pal et al. | 588/256 |

FOREIGN PATENT DOCUMENTS

| | | | |
|---|---|---|---|
| 0584015 | 2/1994 | European Pat. Off. | B03B 9/04 |
| 3918292 | 4/1990 | Germany | A62D 3/00 |
| 9322242 | 11/1993 | WIPO | C02F 1/52 |
| WO 96/14901 | 5/1996 | WIPO . | |

OTHER PUBLICATIONS

Conner, R. "Chemical Fixation and Solidification of Hazardous Waste", (New York: Van Nostrand Reinhold, 1992).

Stiller et al., "An experimental evaluation of the use of rock phosphate (apatite) for the amelioration of acid producing coal mine waste" (1989) 9 *Mining Science and Technology* 283–287.

Renton et al., "The Use of Phosphate Materials as Ameliorants for Acid Mine Drainage".

*Primary Examiner*—Gary P. Straub
*Attorney, Agent, or Firm*—Coudert Brothers

[57] ABSTRACT

A process for treating contaminated waste to stabilize environmentally harmful heavy metals. The waste is contacted with a mixture of a sulfide, preferably calcium sulfide, an inorganic phosphate, which prevents oxidation of sulfide, and a base that at least includes calcium hydroxide. The process stabilizes harmful, heavy metal materials in the waste but avoids the prior art disadvantage of emitting hydrogen sulfide.

11 Claims, No Drawings

TREATMENT PROCESS FOR CONTAMINATED WASTE

This is a continuation of application Ser. No. 08/705,794 filed on Aug. 30, 1996, now abandoned.

FIELD OF THE INVENTION

This invention relates to a process to treat contaminated waste, particularly waste containing toxic materials, to render the toxic metals harmless to the environment and also to suppress hydrogen sulfide production during the process.

DESCRIPTION OF THE PRIOR ART

The treating of heavy metals in waste such as soil, ash, sludge, baghouse dust and sediments, to stabilize the metals, is of increasing importance. These metals can become mobile, enter the ground water, and cause environmental damage to ecosystems. For example, it is of significance where land is rezoned from industrial to recreational or housing use. A particular concern is where the soil, either from natural causes or because of industry previously carried out on the site, contains elements toxic to the environment. These elements can be leached out, become mobile, and enter the water table where they are spread rapidly throughout the environment, causing considerable environmental damage.

It is known to stabilize these elements into a water insoluble form so that they cannot be leached out from the contaminated waste into the environment but existing methods have achieved only limited success.

Commonly owned co-pending U.S. application Ser. No. 08/339,784 filed Nov. 15, 1994, now abandoned in favor of application Ser. No. 08/823,627, filed Mar. 25, 1997 describes and claims a process that is an improvement on prior methods and has achieved excellent commercial success. Using the technology of the above patent application five full scale projects have been completed and there are numerous treatment studies either completed or in progress. There is, however, one disadvantage. The process of the above patent application can produce hydrogen sulfide, a notoriously foul smelling gas. Hydrogen sulfide must be controlled by the collection and treatment of the gases produced in the mixing chamber and the product conveyor belts and by covering the product stockpile with vapor barrier, for example a polyethylene sheet or tarpaulin.

This production of hydrogen sulfide therefore makes the process difficult, complicates the operating conditions and increases the cost of implementing the process. It also restricts the in situ operation. The in situ operation of the process would greatly extend its applicability.

SUMMARY OF THE INVENTION

The present application relates to an improvement in the process described above in that the present invention reduces, or eliminates, the hydrogen sulfide production to the point where it is not a problem in the carrying out of the process.

Accordingly, the present invention provides a process for treating contaminated waste to stabilize environmentally harmful heavy metal comprising:

(a) contacting the contaminated waste with a mixture of (i) a sulfide selected from the group consisting of calcium sulfide, calcium polysulfide, sodium sulfide, sodium hydrosulfide and iron sulfide, (ii) an inorganic phosphate to prevent oxidation of the sulfide and (iii) a base that at least includes calcium hydroxide.

Water may be added, if necessary, to adjust consistency or to assist mass transfer.

The sulfide is used in an amount 0.5 to 8% by weight of the waste. Calcium sulfide is preferred.

The phosphate is added to prevent remobilization of the contaminating metal. The phosphate precipitates any available ferric iron so that the redox potential is insufficient to oxidize metallic sulfide. Orthophosphates are preferred. Specific, preferred phosphates are calcium phosphate ($P_2O_5$), and triple super phosphate.

The phosphate is preferably used in an amount 1 to 8% by weight of the contaminated waste.

The base component is used in an amount sufficient to provide 2 or more times the amount of neutralization capability as there is acid generation potential in the added sulfide. Indeed it is this acid generation that reduces the acidic hydrogen sulfide. As in the above United States patent application the base may include calcium carbonate or calcium oxide or both but it is the calcium hydroxide that is the important feature of the present invention. The addition of the base provides an additional safety measure by supplying in excess of two parts neutralization potential for each part of maximum potential acidity. The base is preferably of small particle size. Calcium hydroxide, which is present in about 0.25% or more by weight of the waste, acts rapidly to bring the initial pH of the mixture above 8.0. The calcium hydroxide is at least 0.25% by weight of the waste and the total base, whether calcium hydroxide, calcium oxide or calcium carbonate is 0.25% to 12% by weight of the waste.

The waste may be acidic or basic and the amount of base added will thus vary, more for an acidic waste, less for a basic waste. The waste may be pretreated prior to stabilizing the metals as taught herein, by such techniques as oxidation or reduction, to convert the metal compounds in the waste into forms that are more easily treated by the present invention.

Although the prior art teaches sulfide alone can be used to stabilize toxic metals in the soil, the addition of phosphate reduces the amount of sulfide required. Furthermore a potential concern with the use of sulfide to form insoluble metal sulfide is the possibility of long term oxidation of the sulfides resulting in the formation of acid that might increase the solubility of the sulfides. If oxidation of the metal sulfide to sulfates should occur the phosphate present in the mixture forms an insoluble metal phosphate. This is, of course, a feature of the earlier filed application.

However the present calcium hydroxide which is an important feature of the present invention, has been found to suppress the release of hydrogen sulfide.

Preferably the phosphate, sulfide and base are added in dry form. They may be mixed prior to addition to the waste.

Water may be added to adjust the consistency of the waste. Water may be added to make the waste the consistency of damp soil or to form a slurry. The addition of water also facilitate mass transfer.

DESCRIPTION OF THE PRESENTLY PREFERRED EMBODIMENTS

The following examples illustrate the invention:

General:

In evaluating the process of the above patent application 08/339,784, strong hydrogen sulfides odors were released and it was decided to measure the pH of the mixture to see whether or not the pH met the stated criterion in the patent application of being greater than 8.5. It was found that only at the highest calcium sulfide addition did the pH exceed 8.5. Strong hydrogen sulfide odors were present regardless of the pH of the treated mixtures. The results are set out in Table 1.

TABLE 1

| | REFERENCE MIXTURES | | | | |
|---|---|---|---|---|---|
| | Control | Mix 1 | Mix 2 | Mix 3 | Mix 4 |
| CaS, % | 0 | 0.5 | 1.0 | 2.0 | 4.0 |
| Phosphate, % | 0 | 1.0 | 1.0 | 1.0 | 1.0 |
| $CaCO_3$, % | 0 | 0.7 | 1.4 | 2.8 | 5.6 |
| $Ca(OH)_2$, % | 0 | 0 | 0 | 0 | 0 |
| Water, % | 0 | 8 | 8 | 9 | 10 |
| pH, 2 hr | 7.7 | 6.3 | 7.0 | 8.1 | 8.6 |
| TCLP Pb, mg/l | 34.4 | 1.68 | 2.16 | 1.26 | 0.12 |
| $H_2S$ Odor | — | Strong | Strong | Strong | Strong |

EXAMPLE 1:

Accordingly experiments were conducted first to double the normal amount of limestone but the hydrogen sulfide release was unchanged. That is to say the release was high. A second mixture replaced all of the limestone used in the mixture with hydrated lime and no hydrogen sulfide odor was observed. A third trial mixture was made, this time using hydrated lime at half the normal limestone dosage and, again, no hydrogen sulfide odor was detected.

A total of eight bench-scale mixtures were made in the laboratory. Each bench scale mixture used 200 grams of contaminated soil, and the percentages of reagents (by wet weight of soil) are shown in Table 2. The soil was contaminated with lead. Note that a leaching value of less than 5.0 mg/l is considered acceptable in the TCLP test (USEPA SW-846, Method 1311).

The reagents were as follows: CaS—special manufacture of dry calcium sulfide, 50% strength; phosphate—triple super phosphate; limestone and hydrated lime—commercially manufactured products. The mixing cycle was as follows: Add phosphate and alkaline reagent—mix 1½ minutes; add CaS—mix 1½ minutes; add water—mix 2 minutes. Mix 1 was done by hand, all other mixes were done in a Hobart N-50 planetary mixer at slow speed.

TABLE 2

| | EXPERIMENTAL MIXTURES | | | |
|---|---|---|---|---|
| | Mix 2 Reference | Mix 2A | Mix 2B | Mix 2C |
| CaS, % | 1.0 | 1.0 | 1.0 | 1.0 |
| Phosphate, % | 1.0 | 1.0 | 1.0 | 1.0 |
| $CaCO_3$, % | 1.5 | 2.8 | 0 | 0 |
| $Ca(OH)_2$, % | 0 | 0 | 1.4 | 0.7 |
| Water, % | 9 | 9 | 9 | 9 |
| pH, 2 hr | 7.0 | 7.4 | 12.3 | 11.2 |
| TCLP Pb, mg/l | 2.16 | DNT | DNT | 1.72 |
| $H_2S$ Odor | Strong | Strong | None | None |

DNT = did not test.

EXAMPLE 2

Additional trial mixtures were made to evaluate the performance of the hydrate mixtures at low CaS addition rates. In these mixtures, very small batches (20 gm each) were hand mixed in the same sequence as the mixes in Example 1. Mix 1A included an amount of lime equal to the stoichiometric equivalent of the limestone which it replaced, thereby not altering the total alkalinity of the mixture, and Mix 1B used ½ of the reference alkaline material dosage. Both mixes used the same contaminated soil used in Example 1, and results were compared against Mix 1 of that example.

TABLE 3

| | EXPERIMENTAL MIXTURES | | |
|---|---|---|---|
| | Mix 1 Reference | Mix 1A | Mix 1B |
| CaS, % | 0.5 | 0.5 | 0.5 |
| Phosphate, % | 1.0 | 1.0 | 1.0 |
| $CaCO_3$, % | 0.7 | 0 | 0 |
| $Ca(OH)_2$, % | 0 | 0.5 | 0.35 |
| Water, % | 8 | 8 | 8 |
| pH, 2 hr | 6.3 | 9.7 | 8.1 |
| pH, 24 hr | 6.5 | 10.1 | 8.7 |
| $H_2S$ Odor | Yes | None | None |

EXAMPLE 3

An additional trial mix, Mix 2C-R, was made using hydrated lime and other ingredients in the same ratios used in Mix 2C of Example 1, but all of the phosphate, calcium hydrate and calcium sulfide were added together at the beginning of the mixing cycle. As in the case of Mix 2C, no $H_2S$ odor was detectable. This shows the effectiveness of the hydrate in providing an "instant" pH in the target range.

EXAMPLE 4

A waste slag from a secondary lead smelter was treated by adding the ingredients shown in Table 4 in a Hobart N-50 mixer in the manner described in Example 1. A 250 gm sample of the slag was used for each mixture. Hydrated lime was used to partially replace the limestone in the mixtures, and minor changes in the dosages of the alkaline materials were made based on the pH of the resulting mixtures. TCLP results were obtained on selected mixes at 1 day of age. Mix designs and results are provided in Table 4.

TABLE 4

| | EXPERIMENTAL MIXTURES | | | | | | |
|---|---|---|---|---|---|---|---|
| | Control | Mix 1 | Mix 1A | Mix 2 | Mix 3 | Mix 4 | Mix 4A |
| CaS, % | 0 | 0.5 | 0.5 | 1.0 | 1.5 | 2.0 | 2.0 |
| Phosphate, % | 0 | 1.0 | 1.0 | 1.0 | 1.0 | 1.0 | 1.0 |
| $CaCO_3$, % | 0 | 0.4 | 0.5 | 0.9 | 1.4 | 1.9 | 1.5 |
| $Ca(OH)_2$, % | 0 | 0.3 | 0.5 | 0.5 | 0.7 | 0.8 | 0.6 |
| Water, % | 0 | 6 | 5 | 6 | 6 | 6 | 5 |
| pH, 2 hr | — | 8.5 | 11.5 | 11.6 | 12.3 | 12.6 | 12.0 |
| TCLP Pb, mg/l | 153 | DNT | 2.93 | 2.39 | 0.05 | DNT | 0.07 |
| $H_2S$ Odor | — | Slight | None | None | None | None | None |

DNT = Did not test.

Although the present invention has been described in some detail by way of example for purposes of clarity and understanding, it will be apparent that certain changes and modifications may be practised within the scope of the appended claims.

I claim:

1. A process for treating contaminated solid waste containing leachable, toxic, environmentally harmful heavy metals comprising:

a) contacting the contaminated solid waste with a mixture comprising: (i) a sulfide selected from the group consisting of calcium sulfide, calcium polysulfide, sodium sulfide and sodium hydrosulfide, said sulfide being in an amount between about 0.5% to about 8% of the weight of the contaminated solid waste, (ii) an inorganic phosphate containing calcium phosphate, said inorganic phosphate being in an amount between about 1% to about 8% by weight of the weight of the contaminated solid waste, and (iii) calcium hydroxide being in an amount of at least 0.25% by weight of the contaminated solid waste;

(b) establishing the pH of the resulting mixture to greater than about 8;

(c) stabilizing said heavy metals sufficient to pass TCLP; and (d) assuring the presence of sufficient water to suppress the emission of hydrogen sulfide during contactin.

2. The process of claim 1, wherein the sulfide is calcium sulfide.

3. The process of claim 1, wherein the soluble metal is lead.

4. The process of claim 1, wherein the calcium phosphate is calcium hydrogen phosphate.

5. The process of claim 1, further comprising the step of mixing the components of the mixture prior to contacting the contaminated solid waste with the mixture.

6. The process of claim 1, further comprising the step of adding water to the contaminated solid waste or to the mixture.

7. The process of claim 1, wherein the contaminated solid waste further comprises ferric iron, and wherein the step of contacting the contaminated solid waste with the mixture further comprises precipitating the ferric iron as a phosphate.

8. The process of claim 1, wherein the step of adjusting the quantity and composition of the mixture is carried out so that the concentration of the calcium phosphate is brought to about 1% to about 3% by weight of the contaminated solid waste.

9. The process of claim 8, wherein the sulfide is calcium sulfide.

10. The process of claim 1 wherein said mixture includes additional base material selected from the group consisting of calcium carbonate, calcium oxide and mixtures thereof.

11. The process of claim 10 wherein said calcium hydroxide and said additional base material comprise 0.25 to 12% by weight of said contaminated solid waste.

* * * * *